US005429490A

United States Patent [19]

Myers et al.

[11] Patent Number: 5,429,490

[45] Date of Patent: Jul. 4, 1995

[54] APPARATUS AND METHOD FOR MANIPULATING PREFABRICATED CONCRETE PRODUCTS

[75] Inventors: Douglas W. Myers, Redmond, Wash.; R. Gary Fjelland, Salem, Oreg.

[73] Assignee: Concrete Products Incorporated, Redmond, Wash.

[21] Appl. No.: 78,541

[22] Filed: Jun. 15, 1993

[51] Int. Cl.[6] ..... B66C 1/30; B22D 29/04

[52] U.S. Cl. ..... 425/436 R; 294/67.33; 294/68.26; 294/86.41; 414/618; 414/741

[58] Field of Search ..... 249/170, 171, 172; 425/436 R, 436 RM, 440, 442, 404; 294/67.33, 86.41, 68.26; 414/741, 618

[56] References Cited

U.S. PATENT DOCUMENTS

| | | | |
|---|---|---|---|
| 2,281,348 | 4/1942 | Breslav | 249/67.33 |
| 3,206,534 | 9/1965 | Vogele et al. | 425/436 |
| 3,348,802 | 10/1967 | Corbett | 249/172 |
| 3,608,163 | 5/1971 | Harford | 425/436 R |
| 4,028,039 | 6/1977 | Putter | 425/436 R |
| 4,111,310 | 9/1978 | Stobb | 294/86.41 |
| 4,252,358 | 2/1981 | Klebs | 294/67.33 |
| 4,256,429 | 3/1981 | Dwyer | 294/86.41 |
| 4,290,729 | 9/1981 | Cary | 414/601 |
| 4,736,971 | 4/1988 | McManus | 294/67.33 |
| 4,750,132 | 6/1988 | Pessina et al. | 294/86.41 |
| 4,842,241 | 6/1989 | Fitzgerald et al. | 249/172 |
| 5,163,804 | 11/1992 | Kobayashi | 294/86.41 |

FOREIGN PATENT DOCUMENTS

| | | | |
|---|---|---|---|
| 1463440 | 12/1966 | France | 294/67.33 |
| 233547 | 3/1986 | German Dem. Rep. | 294/67.33 |
| 244117 | 3/1987 | German Dem. Rep. | 294/67.33 |
| 3023894 | 1/1982 | Germany | 294/86.41 |
| 52-9258 | 1/1977 | Japan | 294/67.33 |
| 4-75799 | 3/1992 | Japan | 425/436 R |
| 5-97380 | 3/1993 | Japan | 294/67.33 |
| 2180213 | 3/1987 | United Kingdom | 294/86.41 |
| 668069 | 6/1979 | U.S.S.R. | 294/86.41 |
| 816934 | 3/1981 | U.S.S.R. | 294/67.33 |
| 1299939 | 3/1987 | U.S.S.R. | 294/67.33 |
| 1648881 | 5/1991 | U.S.S.R. | 294/67.33 |
| 1715614 | 2/1992 | U.S.S.R. | 425/436 R |

OTHER PUBLICATIONS

Hercules Industries Advertisement.

*Primary Examiner*—Khanh Nguyen

*Attorney, Agent, or Firm*—Hughes, Multer & Schacht

[57] ABSTRACT

Apparatus for manipulating concrete products having first and second ends. The apparatus includes first and second engaging assemblies for engaging the first and second ends of the product. The engaging assemblies are mounted on a structural assembly. At least one of the engaging assemblies is displaced along the structural assembly towards the other of the engaging assemblies to grip the concrete product therebetween. A rotational actuator may be provided for each of the engaging assemblies for rotating the concrete product from a casting orientation into an installation orientation. The structural assembly may accommodate one or more sets of engaging assemblies and may be designed to allow fine adjustment of these assemblies relative to the concrete products to be manipulated.

14 Claims, 13 Drawing Sheets

120
126
154
156
130
152
138
134b
134
134a
146
124
122
132a
132
144
132b
150
136
128
5
5

APPARATUS AND METHOD FOR MANIPULATING PREFABRICATED CONCRETE PRODUCTS

TECHNICAL FIELD

The present invention relates to the manufacture of prefabricated concrete products and, more particularly, to the manipulation of such products during the manufacture and installation thereof in a manner that reduces production costs and increases product quality.

BACKGROUND OF THE INVENTION

Reinforced concrete guardrails for use along roadways are prefabricated at one location and shipped to another location for installation. In particular, such guardrails are massed produced in straight sections at a manufacturing site. The straight sections are then transported to roadway where a barrier is required. The sections are then placed end to end along a roadway and secured to each other to form a continuous barrier.

At various times during this process of manufacturing and installing the individual sections it is necessary to manipulate and otherwise move these sections. Forklifts are often used to move the sections around at both the manufacturing site and the installation site. While forklifts are able to accomplish this task, often the bottom edges of the guardrail sections are damaged by the tines of the forklift as the operator attempts to insert the tines underneath the sections. Heretofore, this has been considered acceptable even though such damage detracts from the appearance of the finished barrier because the barrier serves its basic purpose. Further, it is possible to patch the barrier section to repair such damage. However, it would be desirable to eliminate the possibility of this damage.

Additionally, often it is necessary to rotate or otherwise manipulate the individual sections subsequent to the casting process. A relatively advanced apparatus for manipulating these sections during casting is depicted in FIGS. 1 and 2.

Shown in FIG. 1 is a rotating apparatus 20 for rotating a form 22 to facilitate removal of a concrete guardrail section 24 (FIG. 2E) therefrom. The rotating apparatus 20 comprises a main structural member 26, first and second rollers 28 and 30, first and second roller belts 32 and 34, a drive motor 36, a roller shaft 38. The rollers 28 and 30 are connected to the roller shaft 38, which is mounted to the structural member 26 by bearings 40, 42, 44, and 46. The drive motor 36 is mounted to the structural member 26 by a mounting frame 48. A drive shaft 50 of the motor 36 is connected to the roller shaft 38 by a chain 52 such that operation of the motor 36 axially rotates the roller shaft 38. The roller belts 32 and 34 are looped around the rollers 28 and 30. Hooks 54 and 56 extend from the bottom of the structural member 26.

The rotating apparatus 20 operates basically as follows. Tines 58 of a forklift 60 are placed under the structural member 26 (FIG. 2A). The roller straps 32 and 34 are placed underneath the form 22 as shown in FIGS. 1 and 2A. The form 22 is then lifted by raising the tines 58 (FIG. 2B). The motor 36 is then operated to rotate the straps 32 and 34 in the directions shown by arrows A and B in FIG. 2B. The straps 32 and 34 frictionally engage the form 22 such that rotation of the straps 32 and 34 also causes the form 22 to rotate 180° about its lengthwise axis 62 (FIG. 1) into the position shown in FIG. 2C. The tines 58 are then lowered until the form 22 again rests on dunnage 64 (FIG. 2D). The straps are then removed, and the hooks 54 and 56 inserted into loops 66 and 68 on the form 22. The form 22 is then moved in the direction shown by arrow C in FIG. 2D to lift the form 22 off of the guardrail section 24 as shown in FIG. 2E. The forklift 60 may then be employed to move the section 24 as discussed above.

The apparatus 20 is fairly labor intensive because two persons are required to remove the barrier section from the form (one to operate the forklift, the other to manipulate the roller belts) and only one barrier section can be removed at a time. The exemplary apparatus 20 described above requires approximately six man-minutes to remove one barrier section from a form.

While the rotating apparatus 20 discussed above significantly automates the process of removing guardrails sections from their forms, this apparatus 20 is limited in that it: (a) handles only one form at a time; (b) damages the form in the process; and (c) does not address the problems discussed above with current methods of moving guardrail sections around once they have been removed from the form.

Accordingly, it is an objective of the present invention to overcome the above-identified problems by providing improved methods and apparatus for manipulating concrete barrier sections.

RELATED ART

A professional patentability search conducted on behalf of the Applicants uncovered only the following references: (a) U.S. Pat. No. 4,290,729 issued 22 Sep. 1981 to Cary; and (b) a Hercules Industries advertisement depicting a number of forklift attachments. Neither of these references teaches or suggests a device that solves or attempts to solve the problems described above.

SUMMARY OF THE INVENTION

These and other objects are achieved by the present invention, which may be embodied as an apparatus for manipulating concrete products comprising first and second engaging assemblies for engaging ends of the concrete product, a structural assembly on which the engaging assemblies are mounted, and one or more actuators for moving the engaging assemblies together to grip the concrete product therebetween. Because the ends of the product are gripped when it is lifted and manipulated and these ends are normally not exposed when the section is installed to create a barrier, visible damage to the product is greatly reduced.

The manipulating apparatus may also be provided with rotating actuators which rotate engaging members of the engaging assemblies to flip the concrete product from a casting orientation in which it is cast into an installation orientation appropriate for storage, transportation, and final installation. The flipping or rotating of the concrete product can easily be accomplished by the present invention with little manpower and thus significantly decreases production costs of such concrete products in comparison to those associated with the method and apparatus described above in the Background of the Invention section.

An engaging projection preferably extends from the engaging member into a recess in the concrete product formed solely for the purpose of receiving the engaging projection. The interaction of the engaging projection and the recess allows the engaging assembly to bear the weight of the concrete product while entirely by engagement of the end surface of the concrete product.

An alignment projection also preferably extends from the engaging member. The alignment projection contacts a surface of the concrete product before the engaging projection enters the recess in the concrete product to help align the engaging projection with the recess.

The engaging member is preferably spring-mounted to the rest of the engaging assembly to allow the engaging members to deflect slightly when they engage the concrete product; this allows the end to pivot similar to the pivoting allowed by a ball joint and therefore maintain constant and uniform contact with the concrete product.

A stop member and stop projections are preferably provided to limit the rotation of the engaging members between a casting position corresponding to the casting orientation of the concrete product and an installation position corresponding to the installation orientation of the product. This facilitates manipulation of the product between the two most commonly used orientations.

If one engaging member contacts the concrete product first, the system hydraulics are connected such that the other engaging member will continue to travel until contact it also contacts the product and the clamping force can then be achieved. Further, a safety device is provided in the hydraulic system to prevent the unit from unclamping if the hydraulic power is shut off.

The structural assembly is adapted to allow the entire apparatus to be easily picked up by a forklift or other similar device. The structural assembly also preferably allows an engaging axis of the engaging assemblies to be moved without moving the forklift; this can be accomplished by providing a transverse member for each set of engaging assemblies that can be moved relative to main members of the structural assembly. Preferably two or more transverse members are provided to allow a plurality of concrete products to be handled at once.

The present invention may also be embodied as a method of removing a concrete product from a form comprising the steps of arranging first and second engaging assemblies adjacent to the ends of the concrete product, displacing the assemblies towards each other to grip the concrete product, and lifting the engaging members to lift the product out of the form in which it was cast.

The present invention may further comprise the combination of a manipulating apparatus as described above, a forklift, a form for creating concrete products, and the concrete product itself.

DETAILED DESCRIPTION OF THE INVENTION

Figure 4:
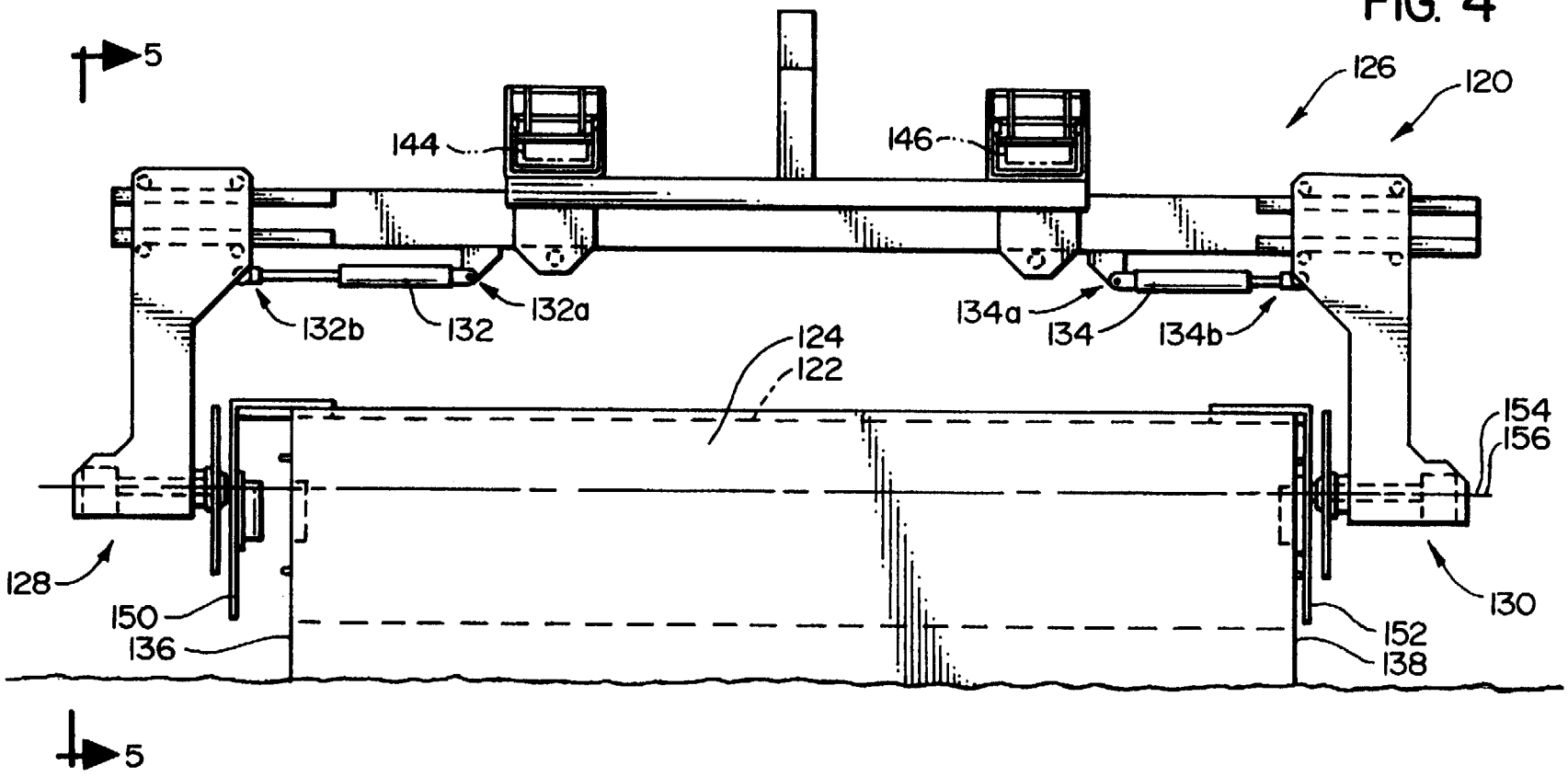
FIG. 4 depicts an apparatus for manipulating concrete products constructed in accordance with, and embodying, the principles of the present invention.

Referring initially to FIG. 4 of the drawing, depicted therein is a manipulating apparatus 120 constructed in accordance with, and embodying, the principles of the present invention. The apparatus 120 is designed to remove a concrete barrier section 122 from a form 124 and otherwise carry and manipulate the section 122 once it has been removed from the form 124.

In particular, the apparatus 120 basically comprises a structural assembly 126 on which first and second engaging assemblies 128 and 130 are mounted. First and second hydraulic linear actuators 132 and 134 are mounted with first ends **132*a* and 134*a* thereof securely attached to the structural assembly 126 and second ends 132*b* and 134*b* securely attached to the engaging assemblies 128 and 130. The first and second hydraulic actuators 132 and 134 are extendible to displace the first and second engaging assemblies 128 and 130 relative to the structural assembly 126**.

In operation, the engaging assemblies 128 and 130 are initially arranged adjacent to first and second ends 136 and 138 of the barrier section 122. One or both of the actuators 132 and 134 are then operated to bring the engaging assemblies 128 and 130 into contact with the barrier ends 136 and 138, thereby gripping the barrier section 122 between the engaging assemblies 128 and 130. The gripping operation just described is self-centering; the exemplary engaging assemblies 128 and 130 are hydraulically controlled to equalize the gripping pressure on the ends 136 and 138. Thus, as one engaging assembly contacts a barrier end, that engaging assembly stops and the other engaging assembly continues to move until engaging pressures are applied by both engaging assemblies. The entire structural assembly 126 may then be raised to raise the engaging assemblies 128 and 130 and thus the barrier section 122 gripped therebetween. The barrier section 122 is thus removed from the form 124.

Figure 5:
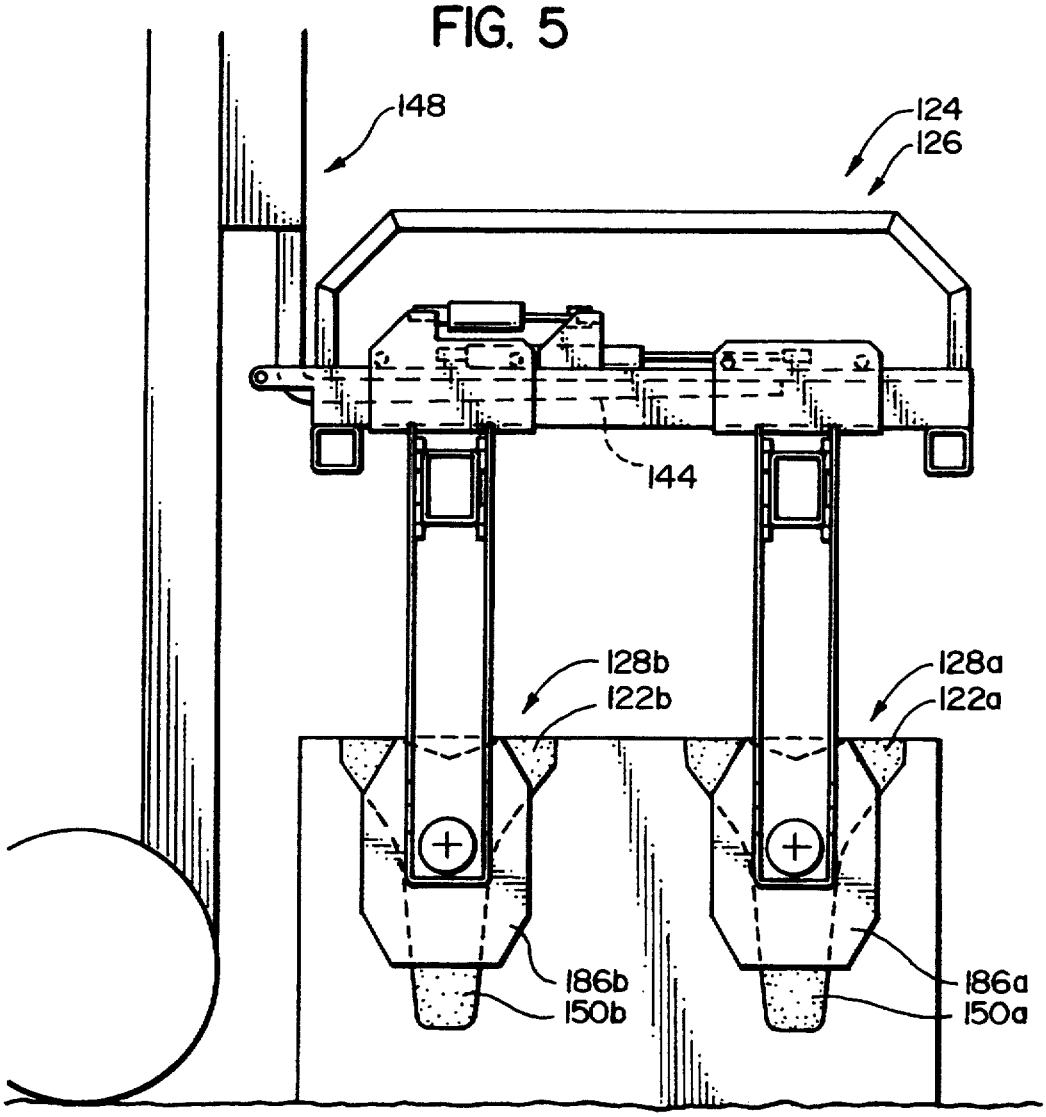
FIGS. 5–8 depict the method of operation of the apparatus depicted in FIG. 4.

The process of raising the barrier section out of the form as just-described is perhaps best shown in FIGS. 3 and 5–7. Referring initially to FIG. 5, it should be apparent that in the exemplary apparatus 120 two pairs of engaging assemblies are provided; in the following discussion, when both of these pairs of assemblies can be seen in the drawing, they will be identified with reference characters **128*a,b* and 130*a,b* to indicate forward and rear pairs of assemblies (for example, reference character 128***b* in FIG. 5 indicates the left rear engaging assembly); front and rear concrete barrier sections 122*a,b* are similarly identified in the Figures. The engaging assemblies are independently operated in the same basic manner, so the discussion herein of any one assembly applies to the remaining assemblies.

Figure 1:
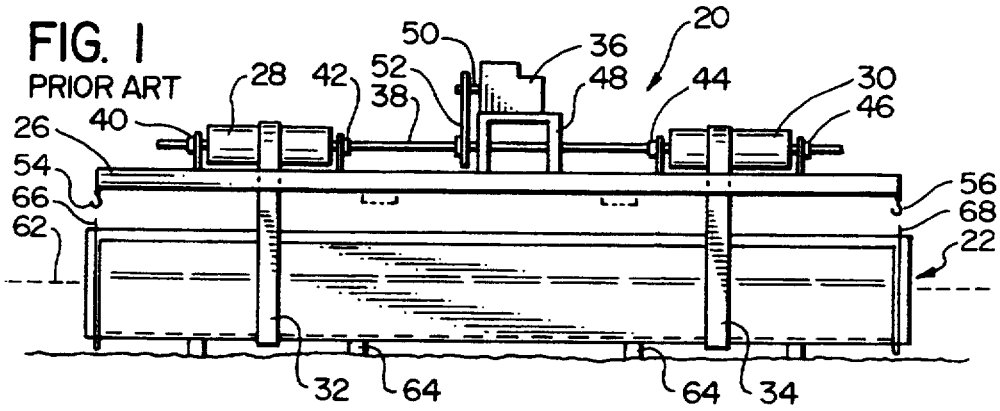
FIG. 1 PRIOR ART
FIG. 1 is a front, isometric view of a prior art apparatus of removing concrete products from a form.
Figure 2A:
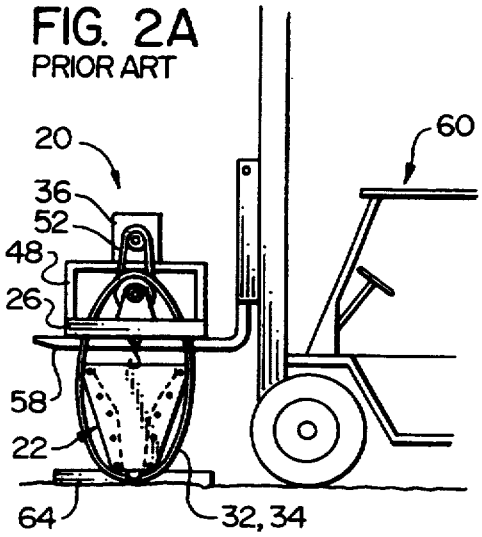
FIG. 2A PRIOR ART
FIGS. 2A 2B, 2C, 2D and 2E depict the operation of the apparatus depicted in FIG. 1.
Figure 2B:
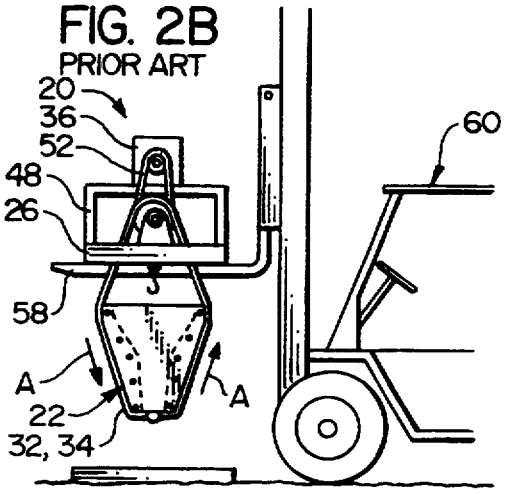
FIG. 2B PRIOR ART
Figure 2C:
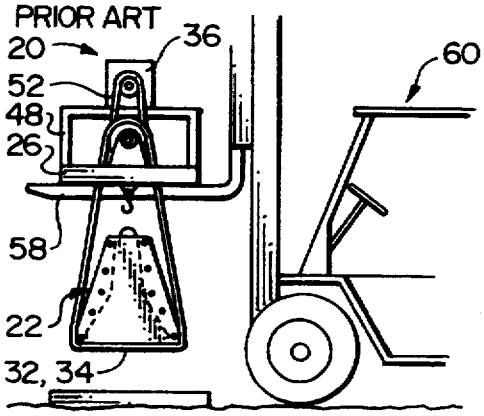
FIG. 2C PRIOR ART
Figure 2D:
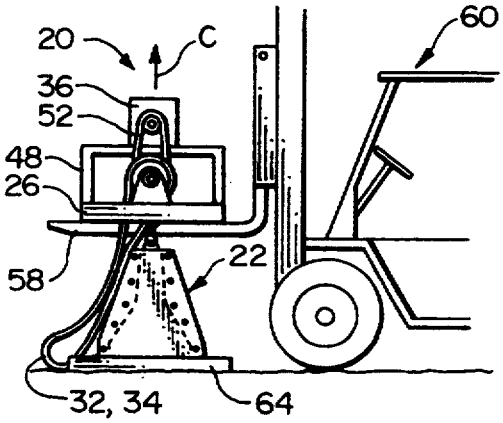
FIG. 2D PRIOR ART
Figure 2E:
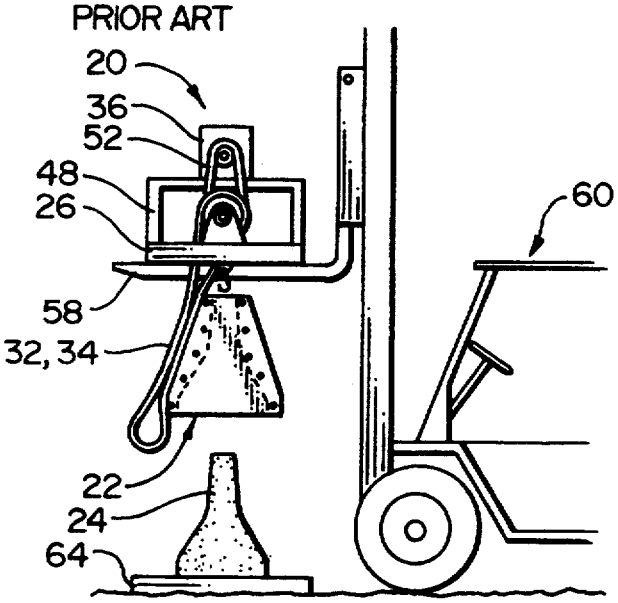
FIG. 2E PRIOR ART
Figure 3:
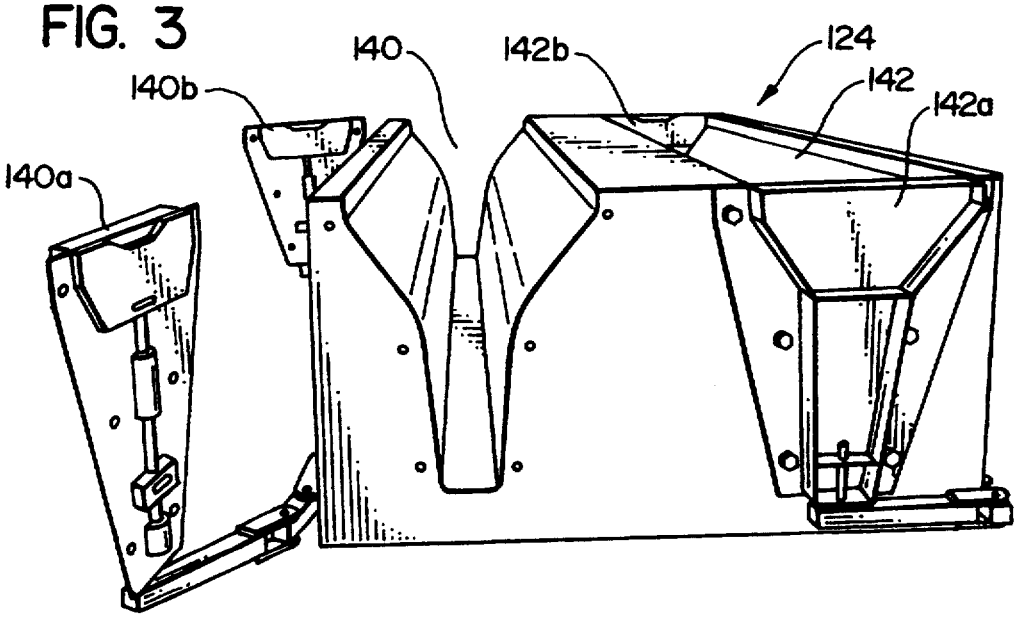
FIG. 3 depicts a form for forming concrete barrier sections such as the type manipulated by the present invention.

Turning now for a moment to FIG. 3, the form 124 will be discussed briefly. The form 124 s adapted to form two concrete barrier sections at a time. The form 124 has forward and rear cavities 140 and 142 into which concrete is poured to form the barrier sections. These cavities 140 and 142 are elongate grooves having a generally V-shaped cross-section. Doors 140*a,b* and 142*a,b* are arranged to block ends of the cavities 140 and 142 (doors 140*a,b* in FIG. 3) or to be opened to allow access to the ends of the cavities 140 and 142 (doors 142*a,b* in FIG. 3). A cover (not shown) is also provided for the form 124 to cover the cavities 140 and 142 for a purpose that will be described in further detail below. As is well-known in the art, a release agent is sprayed onto all surfaces surrounding the cavities 140 and 142 to prevent the concrete in the form 124 from bonding to these surfaces as it sets.

Referring back to FIG. 5, the situation is depicted in which: (a) the cover has been removed from the form; (b) the doors 140*a,b* and 142*a,b* are all opened; and (c) the engaging members 128*a,b* and 130*a,b* extend into the openings created by the opened doors to grip the barrier sections 122*a* and 122*b*.

Figure 6:
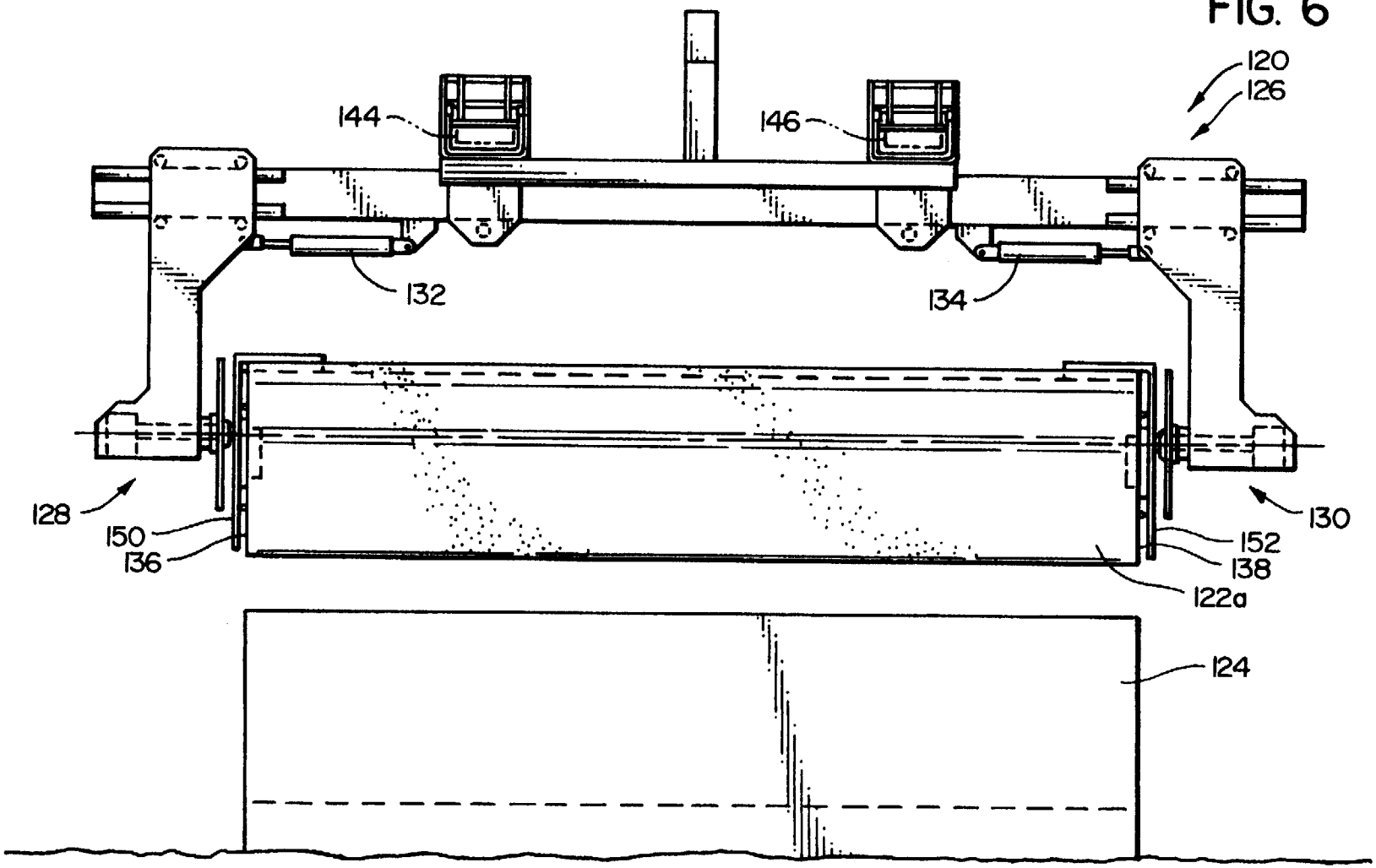
Figure 7:
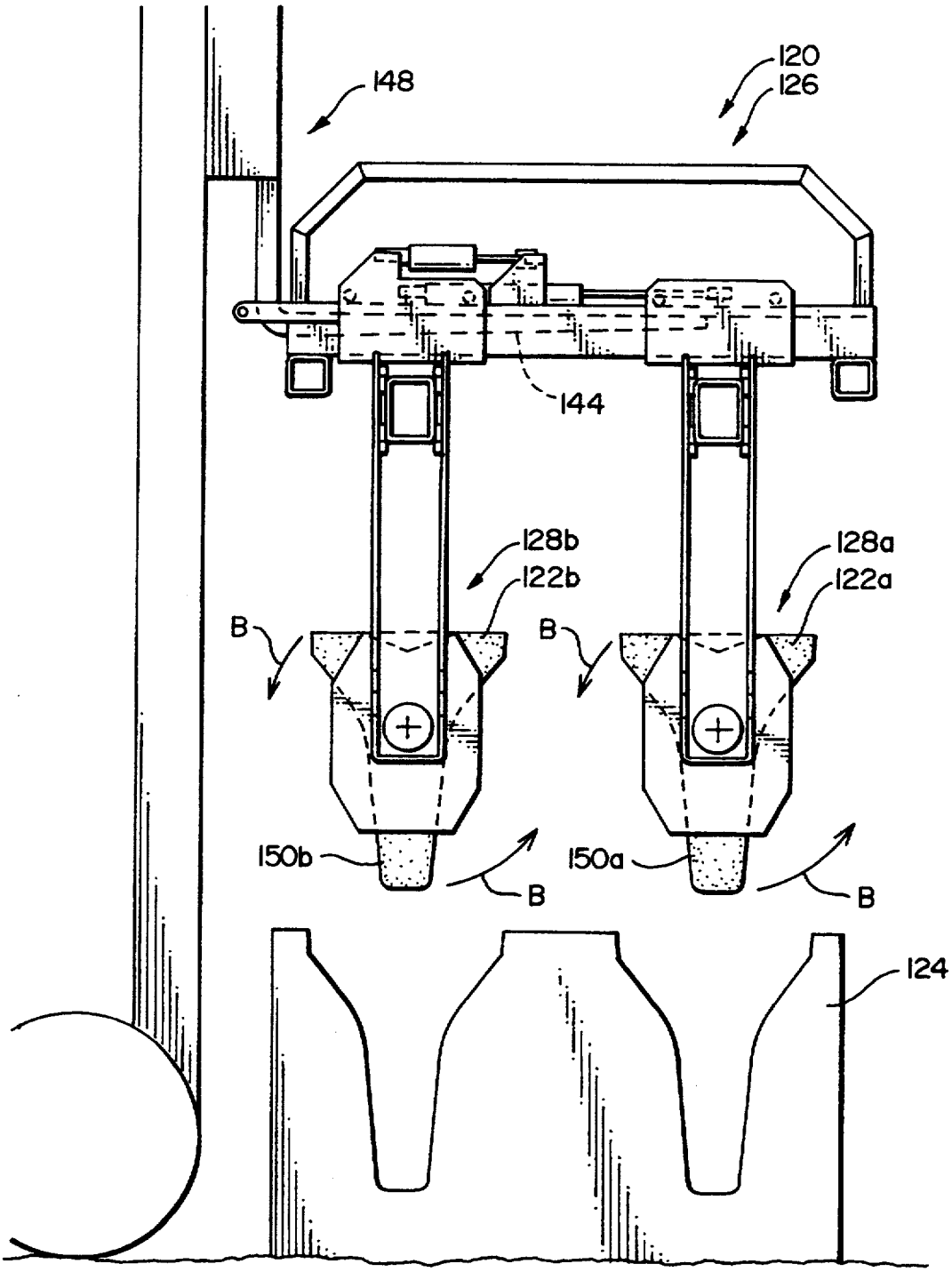

As shown in FIGS. 6 and 7, tines 144 and 146 of a forklift 148 (FIG. 5) engage the structural assembly 126 of the apparatus 120 to lift the entire apparatus 120, along with the barrier sections 122*a* and 122*b* gripped between the engaging assemblies 128*a,b* and 130*a,b*. The bonding agent on the surfaces of the form 124 allow the barrier sections to release from the form; the form 124 thus remains upright on the ground as the barrier sections are removed therefrom.

The V-shaped cavities 140 and 142 result in the barrier sections formed therein being inverted when they are removed from the form 124. The orientation of the barrier sections in the form will be referred to herein as a casting orientation, while the orientation of the barrier sections when they are being stored, transported, or installed for as a barrier will referred to as an installation orientation. The barrier sections 128*a,b* in FIG. 7 are shown in the casting orientation.

Figure 8:
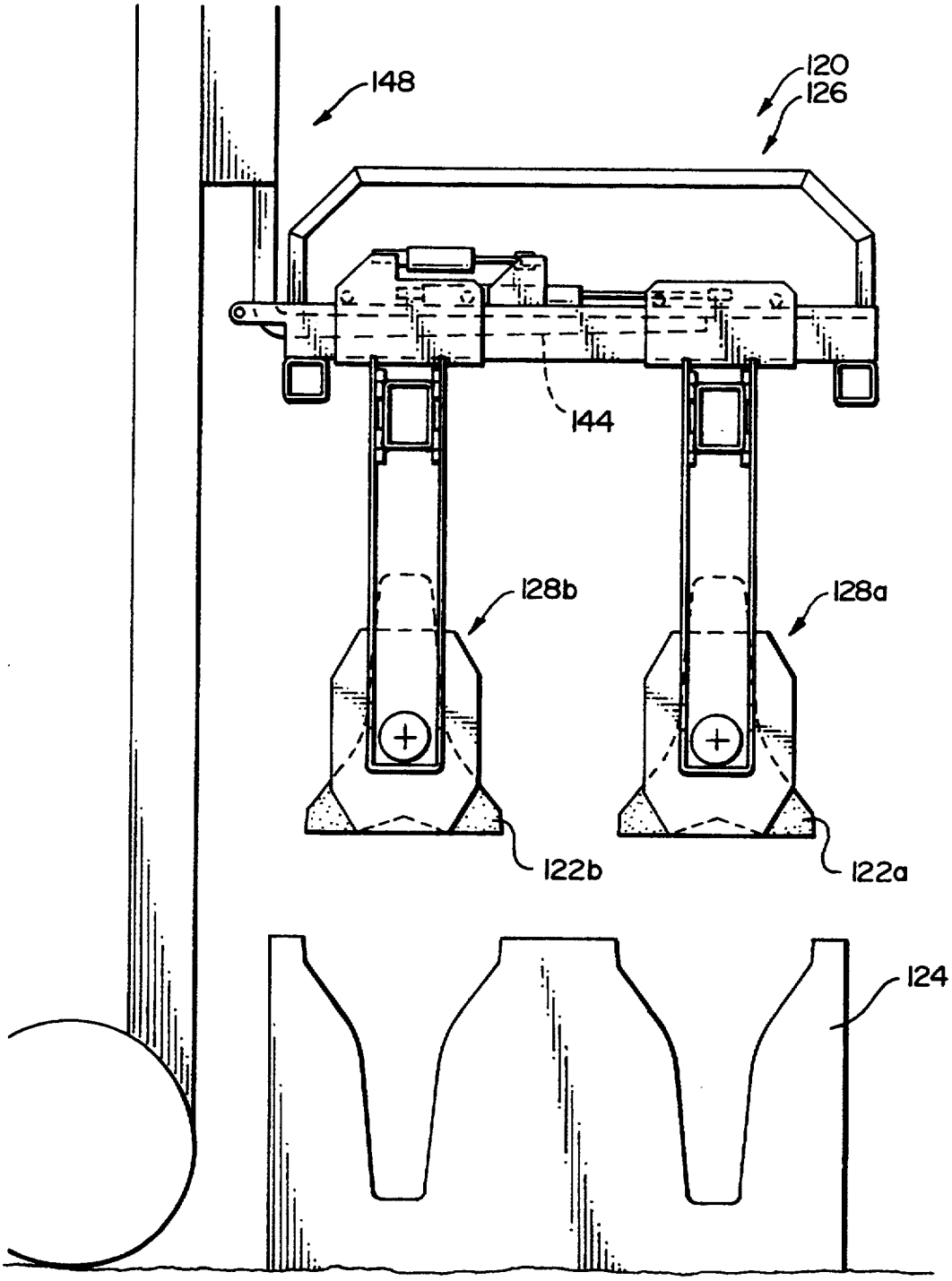

The barrier sections must be rotated into the installation orientation to allow them to be stored until they are ready to be transported to their final destination for use in a barrier. Accordingly, once the barrier sections 128*a,b* have been removed from the form 124, engaging members 150*a,b* and 152*a,b* (FIG. 6) of the engaging members 128*a,b* and 130*a,b* are rotated in the direction indicated by arrows B in FIG. 7 to place the barriers sections 128*a,b* into the installation orientation as shown in FIG. 8. At this point, the forklift 148 may be driven to a desired location where the barrier sections 128*a,b* can be deposited without further handling for storage until they are transported to their final destination.

Before proceeding with a discussion of the details of construction and operation of the present invention, several definitions and reference points will be defined. The terms "forward, front," "backward, back," "top, up," and "bottom, down", refer to the directions to the right, left, top, and bottom, respectively, in FIGS. 5, 7, and 8. The terms "left" and "right" correspond to the left and right in FIGS. 4 and 6. The term "engaging axis" refers to the axis about which the engaging members 150 and 152 rotate; the engaging axis is identified by reference character 154 in FIG. 11. An axis is also defined for the barrier section 122; this axis will be referred to herein as the "product axis" or the lengthwise axis of the barrier section and is identified as 156 in FIGS. 10 and 11. The terms "inner" and "outer" refer to the towards and away from, respectively, the barrier section along the product axis.

Figure 9:
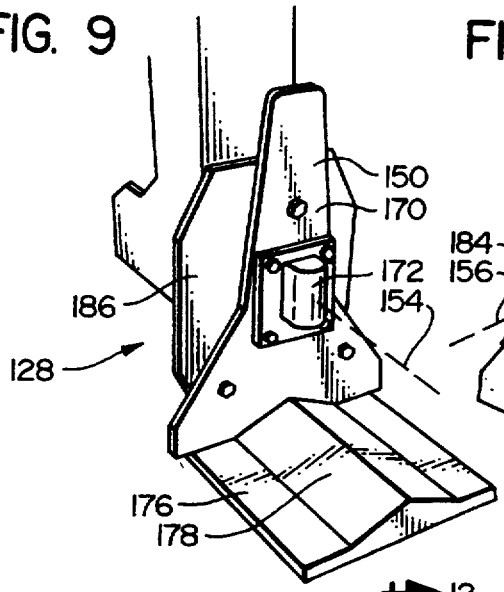
FIG. 9 is a perspective view of an engaging assembly of the apparatus depicted in FIG. 4.
Figure 10:
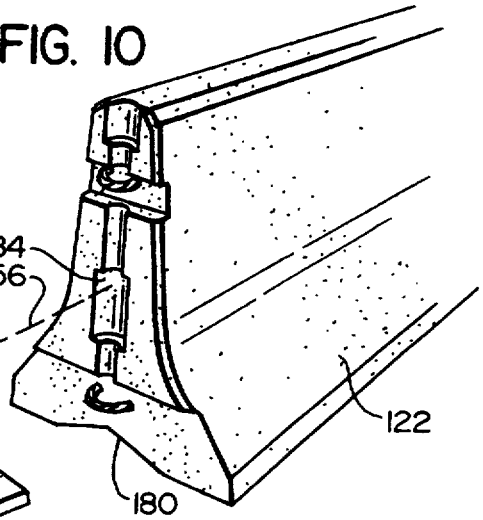
FIG. 10 is a perspective view of one end of a concrete barrier section such as that formed by the form depicted in FIG. 3 and manipulated by the present invention.
Figure 11:
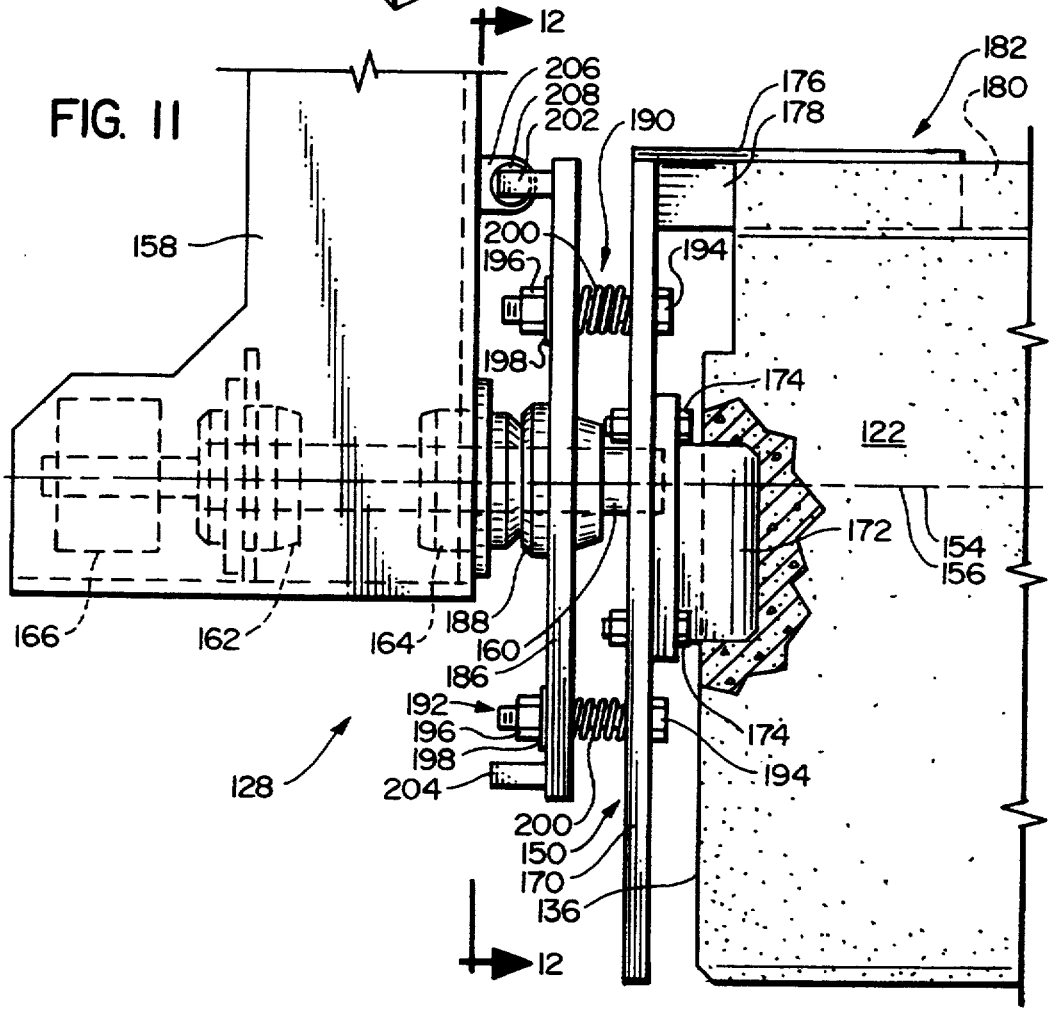
FIG. 11 is a cut-away, somewhat schematic view of the engaging assembly depicted in FIG. 9.

Referring primarily to FIGS. 9, 10, and 11, the engaging assemblies introduced above will now be described in further detail. As discussed above, the engaging assemblies operate in the same manner and only one will be described in detail herein. As is perhaps best shown in FIG. 11, the engaging assembly 128 basically comprises a support member 158 and the engaging member 150 discussed above. The support member 158 is connected to the structural assembly 126 in a manner that allows the entire engaging assembly 128 to move along the engaging axis 154. The connection between the support member 158 and the structural assembly 126 also allows the weight of the barrier section 122 to be transmitted through the support member 158 to the structural assembly 126.

The engaging member 150 slides and pivots on a bearing shaft 160. The bearing shaft 160 is supported by bearings 162 and 164 attached to the support member 158. The bearings allow the bearing shaft 160 to rotate about its axis relative to the support member 158. Loads on the engaging member 150 are transmitted to an end plate 186 which is connected to the shaft 160. A rotational actuator 166 is also mounted on the support member 158. The exemplary actuator 166 is hydraulically controlled to rotate the output shaft 160 about its axis.

The exemplary engaging member 150 basically comprises an end plate 170 and an engaging projection 172. The engaging projection 172 may be integrally formed on the plate 170, but, in the exemplary engaging assembly 128, is bolted thereto by sets of nuts and bolts 174. The engaging member 150 slides and pivots on the bearing shaft 160. Axial rotation of the shaft 160 causes the end plate and engaging member to rotate about the engaging axis 156.

As perhaps best shown in FIG. 9, extending from the end plate 170 is an alignment plate 176. An alignment projection 178 is formed on the plate 176. The alignment projection 178 is generally triangular in cross-section to conform with a cavity 180 having a similar cross-sectional shape in the barrier section 122 (FIG. 10). As shown generally at 182 in FIG. 11, the exemplary alignment plate 176 extends orthogonally from the end plate 170 such that, in use, the alignment projection extends into and contacts the barrier section 122 at the cavity 180 therein.

The alignment projection 176 contacts the barrier section 122 before the engaging projection 172 contacts the barrier section 122. The alignment projection 178 thus guides the entire engaging member 150 such that the engaging projection 172 is aligned with a recess 182 formed in an end surface 184 of the barrier section 122. The triangular cross-sectional configuration of the alignment projection 178 is important to this alignment process, but other configurations could obtain a similar alignment effect. Thus, the engaging projection 172 enters the recess 182 when the engaging assembly 128 is displaced towards the barrier section 122 by the linear actuator 132 as described above.

The alignment plate 176 is most useful as the operator is learning how to operate the apparatus 120 and may be dispensed with after the operator reaches a certain level of proficiency.

The interaction of the engaging projection 172 and the recess 182 in the barrier section 122 greatly enhances the ability of the apparatus 120 to manipulate barrier sections. In particular, the substantial weight of the barrier section 122 is transferred: (a) by the engaging projection 172 to the end plate 170; (b) by the end plate 170 to the shaft 160; (c) by the shaft 160 to bearings 162 and 164; (d) by the bearings to the support member 158; and (e) by the support member to the structural assembly. Because both ends of the barrier section are similarly borne by engaging assemblies, the apparatus 120 securely grips the barrier sections in a manner that allows lifting and transportation by the forklift 148 and rotation about the product axis by the rotational actuators 166.

Figure 12:
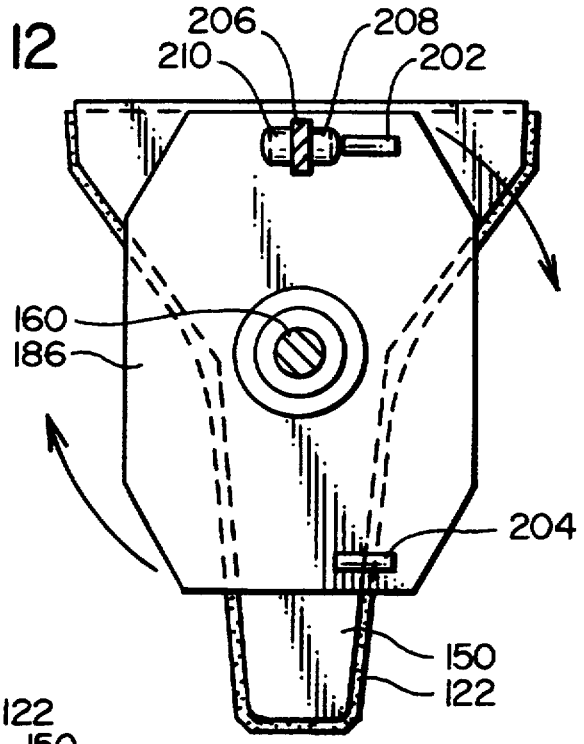
FIGS. 12 and 13 depict the operation of stop members and stop projections of the engaging assembly depicted in FIG. 11.

However, it should be noted that in many cases sufficient frictional force may be generated between the engaging members and the barrier sections that an engaging projection may be unnecessary. Also, in lieu of an engaging projection and complimentary recess specifically formed to receive the engaging projection, a surface on the engaging member may be formed to conform to the existing profile of the end of the barrier section. This conforming surface would act in a manner similar to that of the engaging projection. Another important aspect of the engaging assembly 128 is the operation of an intermediate plate indicated by reference character 186 in FIGS. 11, 12, and 13. The intermediate plate 186 is rigidly mounted on the shaft 160 between the bearing 164 and the engaging member 150 by an sleeve 188.

The end plate 170 is connected to the intermediate plate 186 by three connecting assemblies, two of which are shown and identified by reference characters 190 and 192 in FIG. 11. Each connecting assembly comprises a bolt 194, a nut 196, a washer 198, and a spring 200. These connecting assemblies allow a limited range of movement between the plates 186 and 170 in the direction of the engaging axis while transmitting rotational torque from the shaft 160 to the end plate 170. The springs 200 oppose movement of the engaging member 150 along the engaging axis 154 away from the barrier section 122. The connecting assemblies thus allow the engaging member 150 to engage the end of the barrier section 122 with a pivot connection similar to a ball joint and therefore maintain contstant uniform contact.

The intermediate plate 186 also comprises first and second stop projections 202 and 204 that extend back towards the support member 158. A stop member 206 is formed on the support member 158. Bumpers 208 and 210 are provided on the stop member 206 to absorb shocks generated by the impact of the stop projections 202 and 204 thereon as will be discussed below.

Figure 13:
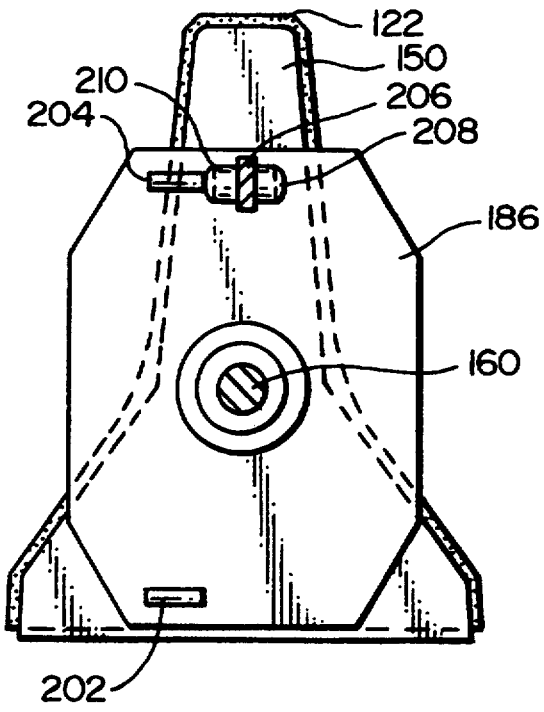

The stop projections 202 and 204 engage the stop member 206 when the engaging member 150 is in first and second positions. In particular, the stop projection 202 engages the stop member 206 when the engaging member 150 is in a casting position (FIGS. 11 and 12), while the stop projection 204 engages the stop member 206 when the engaging member 150 is in an installation position (FIG. 13). The casting and installation positions of the engaging member 150 correspond to the casting and installation orientations of the barrier section 122: when the barrier section is gripped by the apparatus 120 in the casting orientation, the engaging member 150 is in the casting position; when the barrier section 122 is held by the apparatus 120 in the installation orientation, the engaging member 150 is in the installation position.

The exemplary structural assembly 126 mentioned briefly above will now be described in further detail. The structural assembly 126 has the basic purpose of providing a structural connection between a lifting device such as the forklift 148 and the engaging members 128 and 130 that allows the engaging members 128 and 130 to operate as described above. As intimated above, the exemplary structural assembly 126 is designed to accommodate four engaging members to allow two barrier sections to be manipulated at the same time. One of ordinary skill in the art will recognize that a structural assembly designed to accommodate one or more than two concrete barrier sections could also be constructed as required by a given manufacturing environment according to the present invention.

Referring now to FIGS. 14–18, the structural assembly 126 comprises first and second main structural members 212 and 214 into which the tines 144 of the forklift 148 may be inserted. The entire weight of the apparatus 120 and anything carried thereby is borne by the tines 144. The structural assembly 126 also comprises a rigidifying framework 216 for maintaining the main structural members 212 and 214 parallel to and a set distance apart from each other.

Mounted transversely on the main members 212 and 214 are front and back transverse members **218*a* and 218*b*. The engaging assemblies 128*a* and 130*a* are mounted on the front transverse member 218*a*, and the engaging assemblies 128*b* and 130*b* are mounted on the back transverse member 218*b*. One transverse member is provided for each barrier section to be manipulated by the apparatus 120**.

Figure 14:
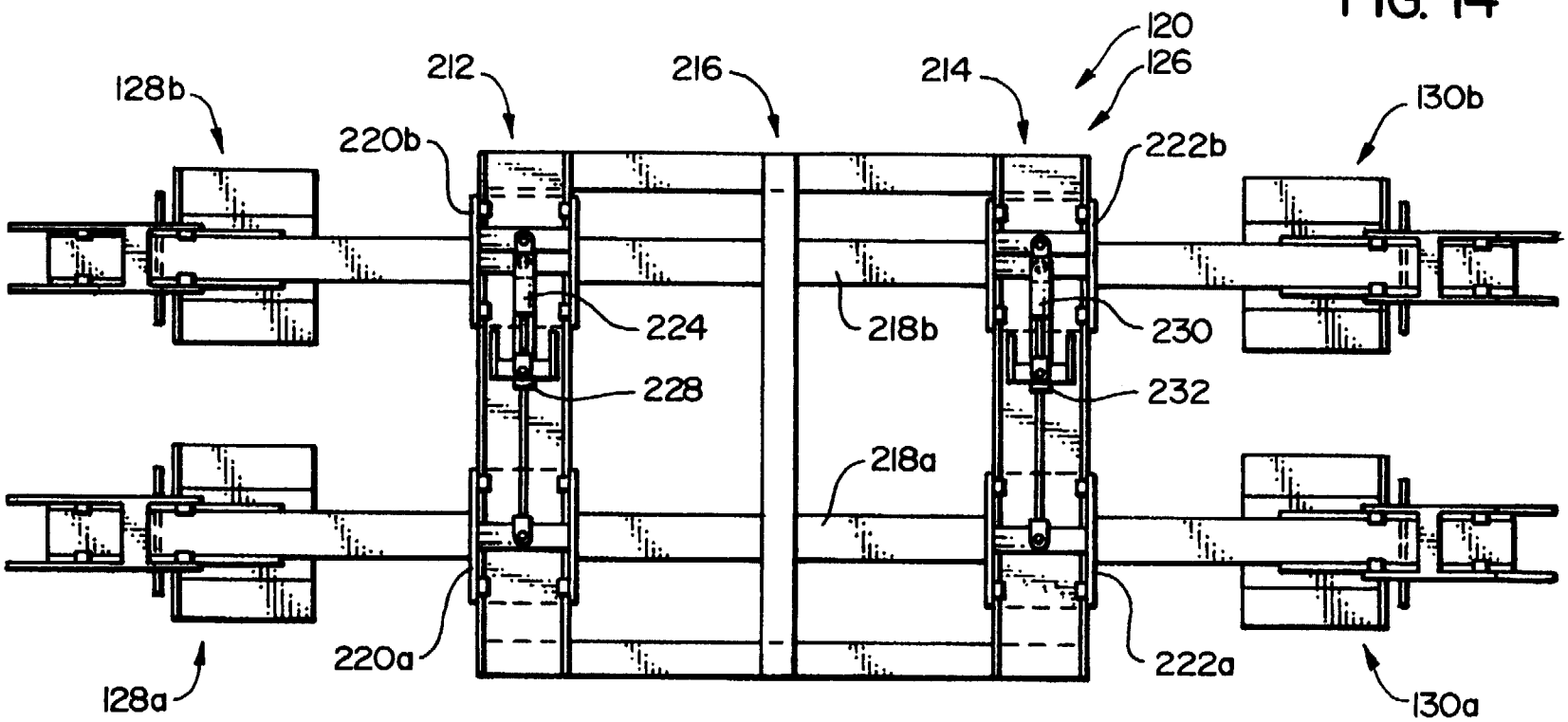
FIG. 14 is a top, plan view of the apparatus depicted in FIG. 4 showing details of construction of the structural assembly thereof.

These front and back transverse members **218*a* and 218*b* are mounted on the main members 212 and 214 by trucks 220*a*, 222*a* and trucks 220*b*, 220*b*, respectively (FIG. 14). These trucks 220 and 222 are designed to allow the transverse members 218*a* and 218*b* to traverse along the main members 212 and 214**. This allows the concrete products to be pulled together for close storage as required.

Figure 16:
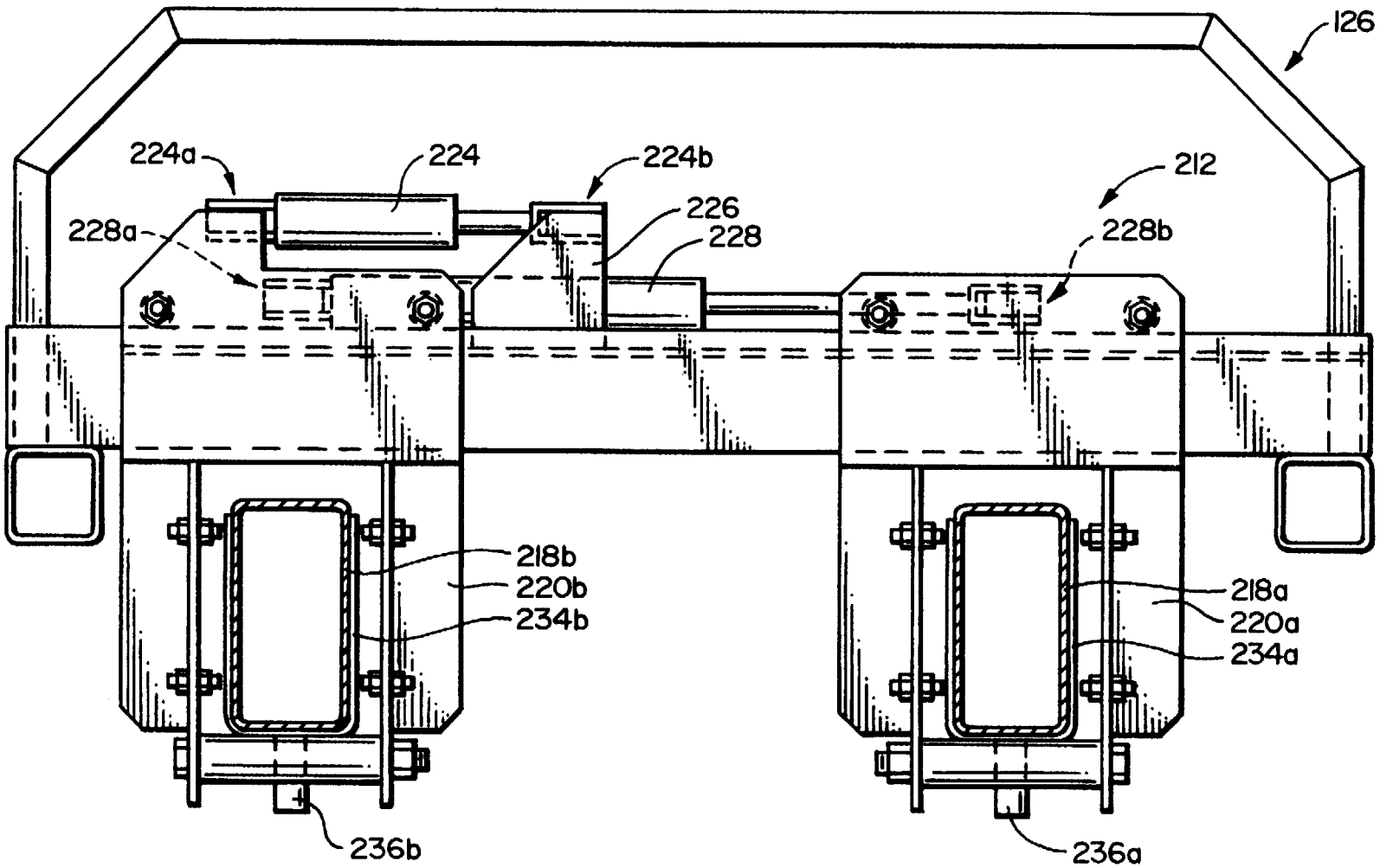
FIG. 16 depicts trucks that interconnect the transverse and main members of the structural assembly shown in FIG. 14.
Figure 17:
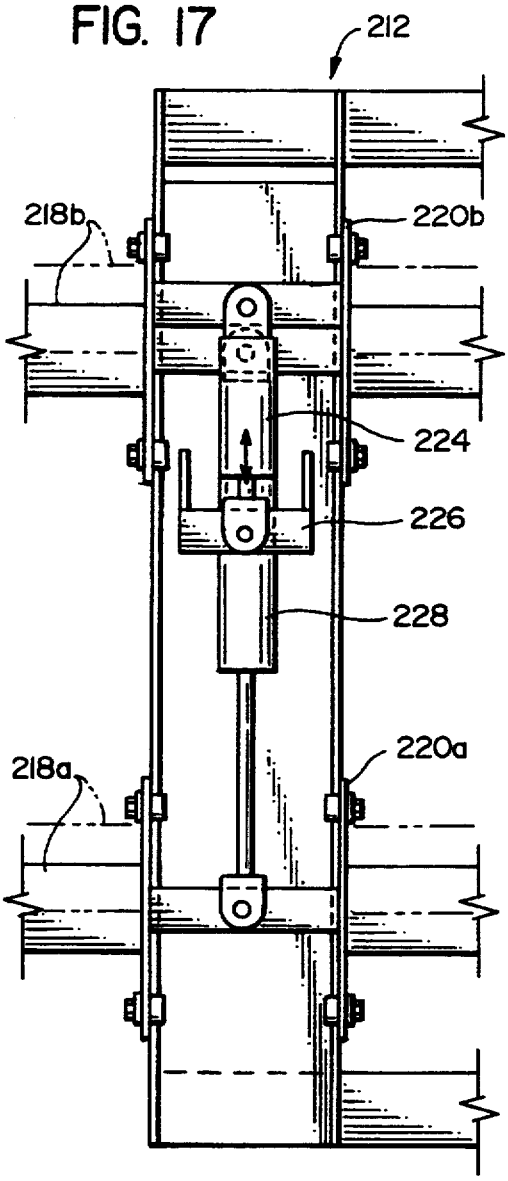
FIGS. 17 and 18 show the operation of linear actuators employed to move the transverse members relative to the main members of the structural assembly depicted in FIG. 14.
Figure 18:
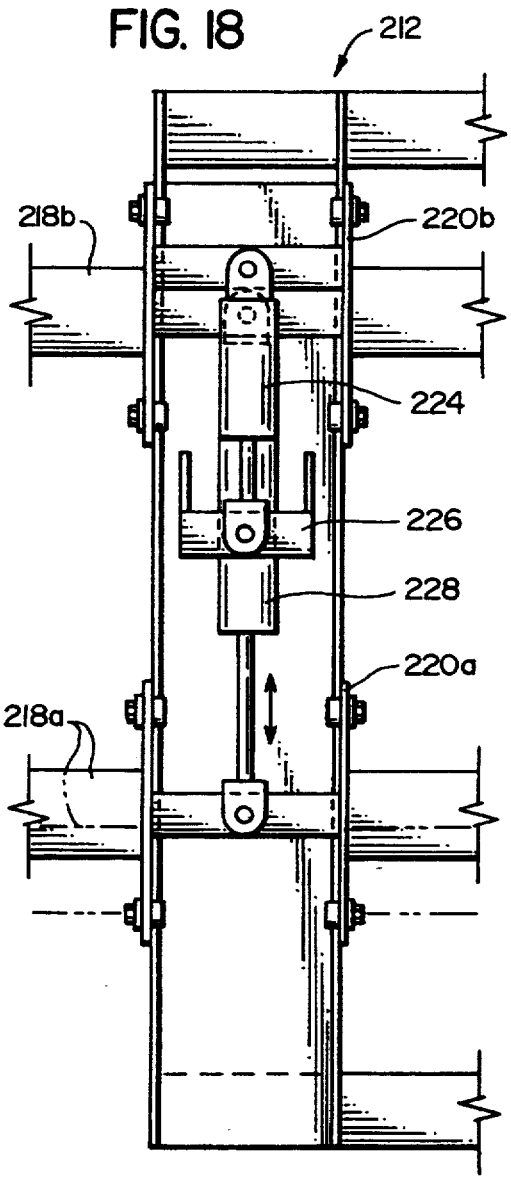

Referring now more particularly to FIG. 16, it can be seen that a first linear actuator 224 is connected at a first end **224*a* the rear truck 220*b* and at a second end 224*b* to a flange 226 attached to the main member 212. A second linear actuator 228 has a first end 228*a* connected to the rear truck 220*b* and a second end 228*b* connected to the forward truck 220*a*. As generally shown in FIGS. 17 and 18, the exemplary actuators 224 and 228 are hydraulic devices that extend and retract; by comparing the positions of the trucks 220*a,b* in FIGS. 17 and 18, it can be seen that this extension and retraction causes the trucks 220*a* and 220*b* to move along the main member 212**.

Also, because the first end of the second linear actuator 228 is connected to the rear truck **220*b*, the front truck 220*a* moves relative to the rear truck 220*b*. The distance between the two trucks can therefore be adjusted as required for a given form and then only the first actuator 224** need be operated to move both trucks in tandem.

Figure 15:
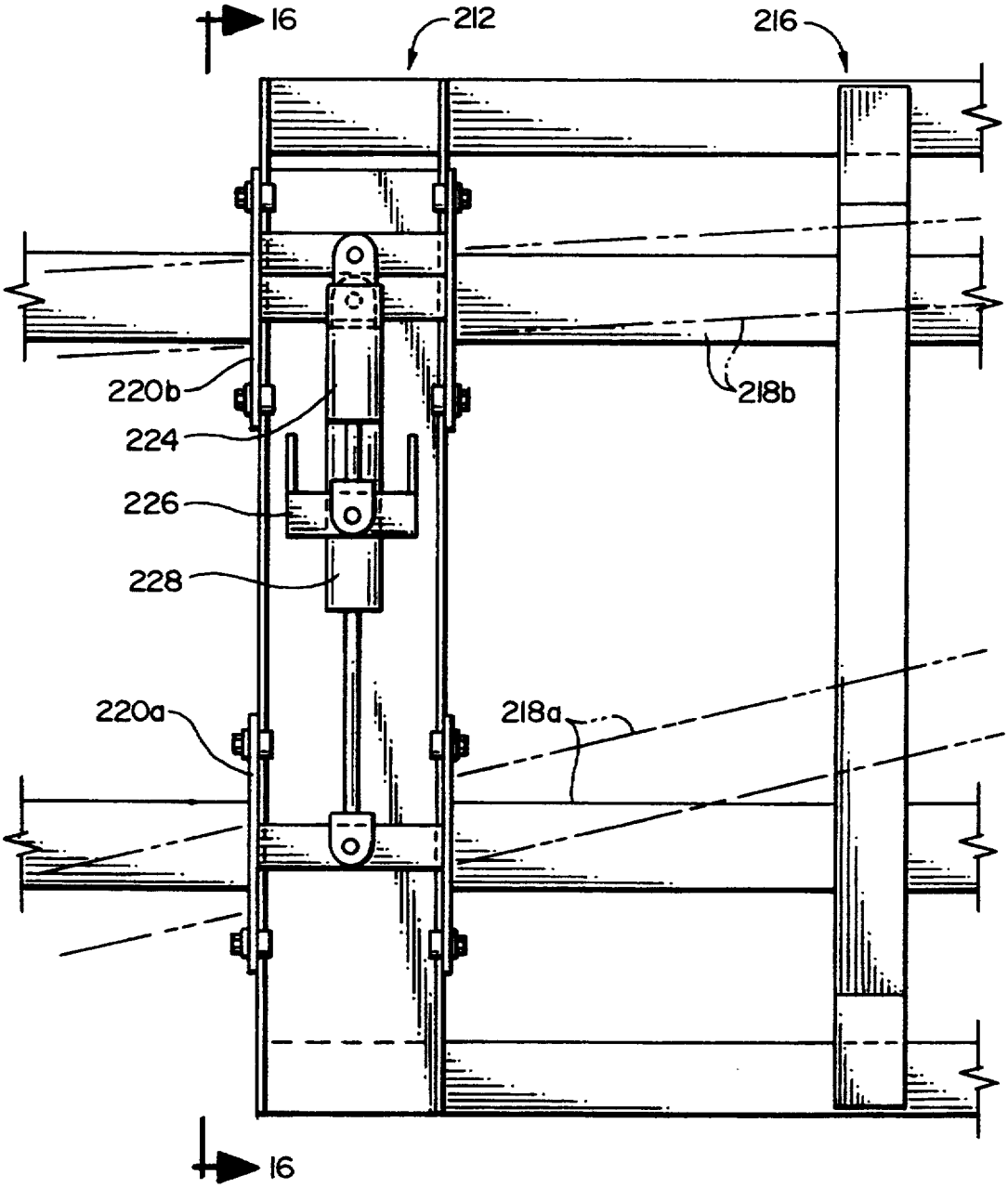
FIG. 15 shows that transverse members of the structural assembly shown in FIG. 14 can be skewed relative to main members of this assembly.

Further, third and fourth linear actuators 230 and 232 (FIG. 14) are similarly connected to the between the main member 216 and the truck 22*b* and the trucks 222*b* and 222*a*. The trucks 220*a,b* may thus be operated independently of the truck 222*a,b*. This allows the transverse members 218*a,b* to skewed relative to each other and to be set at angles relative to the main members 214 and 216. This is shown in FIG. 15, where the front and back transverse members 218*a,b* are depicted parallel to each other and at right angles to the main members 214 and 216 by solid lines and skewed relative to each other and non-parallel to the main members 214 and 216 by dashed lines.

To allow the independent operation of the trucks 220 and 222, FIG. 16 shows that the transverse members 218*a* and 218*b* have U-shaped doubler plates 234*a* and 234*b*. These plates 234*a,b* have stop pins 236*a* and 236*b* attached to the bottoms thereof; the transverse members sit freely on the the trucks 220*a* and 220*b* in a manner that allows the pivoting of the transverse members 218*a* and 218*b*. Further, the transverse members 218*a* and 218*b* can float up and down within the trucks 220*a,b*. Accordingly, as the angle between either of the transverse members 218*a* and 218*b* and the main members 214 and 216 becomes acute or obtuse, the doubler plates 234*a,b* rotate as necessary to accommodate such angles. Further, the floating connection between the members 214 and 216 and the mounts 234*a,b* allow these members to move up or down.

The structural assembly 126 thus allows the position and angle of the transverse members to be finely adjusted to allow precise manipulation of the barrier section supported thereby.

The manipulating apparatus 120 constructed and used as described above requires approximately one man-minute of labor to remove one barrier section from a form. This represents a significant savings of labor costs over the six man-minutes employed by the prior art apparatus 20 described in the Background section above.

It should be clear that the present invention may be embodied in forms other than that described above. The above-described example is therefore to be considered in all respects illustrative and not restrictive, the scope of the invention being indicated by the appended claims rather than the foregoing description. All changes that come within the meaning and scope of the claims are intended to be embraced therein.

I claim:

1. An apparatus for manipulating a concrete product having first and second ends and a lengthwise axis, comprising:

a. first and second engaging means arranged adjacent to the first and second ends of the concrete product, respectively, for engaging these first and second ends;

b. a structural assembly on which the engaging means are mounted;

c. means for displacing at least one of the engaging means along the structural assembly towards the other of the engaging means such that the concrete product is gripped between the first and second engaging means;

d. rotating means for rotating the engaging means, where rotation of the engaging means causes the concrete product to rotate about its lengthwise axis;

e. limiting means for limiting rotation of the concrete product between first and second positions relative to the structural assembly; wherein f. the first and second engaging means each comprises first and second support members movably mounted on the structural assembly and first and second engaging members mounted to the first and second support members, respectively for rotation about an engaging axis, the engaging members coming into contact with the concrete product when the engaging means engages the concrete product;

g. the rotating means comprises actuating means attached to each support member for rotating the engaging members about the engaging axis relative to the support member; and h. the limiting means comprises at least one stop member and first and second stop projections extending from at least one of the engaging members such that, when the concrete product is in the first position, the first stop projection engages the stop member and when the concrete product is in the second position, the second stop projection engages the stop member.

2. An apparatus as recited in claim 1, in which the engaging means further comprises an engaging projection extending towards the concrete product from each engaging member, where, when the engaging means engages the concrete product, each engaging projection is received in a recess in the concrete product such that the weight of the the concrete product is primarily transmitted to the engaging members by the projections.

3. An apparatus as recited in claim 2, in which the engaging means further comprises an alignment projection extending towards the concrete product from each engaging member, where, as the engaging means engages the concrete product, each alignment projection contacts a surface of the concrete product to align the engaging projection with the recess in the concrete product.

4. An apparatus as recited in claim 1, in which the first and second engaging members are further mounted to the first and second support members to allow movement of the engaging members along the engaging axis relative to the support members.

5. An apparatus as recited in claim 4, in which the engaging means further comprises means for resiliently opposing movement of the engaging members along the engaging axis away from the concrete product.

6. A apparatus as recited in claim 1, further comprising elevating means for engaging the structural assembly to elevate and transport the concrete product when the concrete product is gripped between the engaging means.

7. An apparatus as recited in claim 6, in which the structural assembly comprises:

a at least one main member for allowing the elevating means to engage the structural assembly; and b. at least one transverse member mounted on the at least one main member for supporting the first and second engaging means.

8. An apparatus as recited in claim 7, in which:

a. the structural assembly comprises first and second main members;

b. the transverse member is arranged across and is movable relative to the first and second main members; and c. the structural assembly further comprises a pair of structural actuating means for moving the transverse member along the first and second main members.

9. An apparatus as recited in claim 7, in which:

a. the first engaging means comprises a first support member attached to a first end of the transverse member and a first engaging member mounted to the first support member for rotation about an engaging axis, the first support member coming into contact with the first end of the concrete product when the first engaging means engages the concrete product;

b. the second engaging means comprises a second support member attached to a second end of the transverse member and a second engaging member mounted to the second support member for rotation about the engaging axis, the second support member coming into contact with the second end of the concrete product when the second engaging means engages the concrete product; and b. further comprising means mounted on the first and second support members for rotating the first and second engaging members about the engaging axis relative to the support member.

10. An apparatus as recited in claim 9, in which the displacing means comprises a pair of displacement actuating means for causing the first and second support members to move along the transverse member.

11. An apparatus as recited in claim 7, in which a plurality of transverse members are provided across the at least one main member, where a pair of first and second engaging means is associated with each transverse member.

12. An apparatus as recited in claim 1, in which an engaging axis extends through the engaging means and the rotating means comprises:

a. an intermediate member connected to the structural assembly; and b. at least one connecting means for connecting the intermediate member to the engaging means such that the engaging means can move relative to the intermediate member along the engaging axis.

13. An apparatus as recited in claim 12, further comprising:

a. the rotating means attached to structural assembly for rotating a bearing shaft about the engaging axis; wherein b. the intermediate member is securely attached to the bearing shaft such that the intermediate member rotates about the engaging axis with the bearing shaft; and c. the connecting means connect the intermediate member to the engaging means such that rotation of the intermediate member about the bearing shaft cause rotation of the engaging means about the engaging axis.

14. An apparatus for manipulating a concrete product having first and second ends, comprising:

a. first and second engaging means arranged adjacent to the first and second ends of the concrete product, respectively, for engaging these first and second ends;

b. a structural assembly on which the engaging means are mounted;

c. means for displacing at least one of the engaging means along the structural assembly towards the other of the engaging means such that the concrete product is gripped between the first and second engaging means;

d. rotating means for rotating the engaging means, where rotation of the engaging means causes the concrete product to rotate about a lengthwise axis thereof;

e. where the first and second engaging means each comprises first and second support members movably mounted on the structural assembly and first and second engaging members mounted to the first and second support members, respectively, for rotation about an engaging axis, the engaging members coming into contact with the concrete product when the engaging means engages the concrete product;

f. where the rotating means comprises actuating means attached to each support member for rotating the engaging members about the engaging axis relative to the support member; and g. at least one stop member and first and second stop projections extending from at least one of the engaging members such that, when the concrete product is in a first position, the first stop projection engages the stop member and, when the concrete product is in a second position, the second stop projection engages the stop member.

* * * * *